US007175442B2

(12) United States Patent
Sanftleben et al.

(10) Patent No.: US 7,175,442 B2
(45) Date of Patent: Feb. 13, 2007

(54) DEVICE FOR ELECTRICALLY CONNECTING CONTACT PINS TO TERMINAL PINS OF A PLUG CONNECTOR WHICH IS FORMED BY THE DEVICE

(75) Inventors: Emanuel Sanftleben, Plaher (DE); Marcus Unruh, Zeitlarn (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/266,540

(22) Filed: Nov. 3, 2005

(65) Prior Publication Data

US 2006/0121767 A1 Jun. 8, 2006

(30) Foreign Application Priority Data

Nov. 5, 2004 (DE) ..... 10 2004 053 491

(51) Int. Cl.
*H01R 33/00* (2006.01)

(52) U.S. Cl. ..... 439/34; 439/130; 439/557

(58) Field of Classification Search ..... 439/34, 439/130, 730, 557–558, 604, 722, 874
See application file for complete search history.

(56) References Cited

U.S. PATENT DOCUMENTS 6,551,137 B2 * 4/2003 Pfaff et al. ..... 439/607
6,974,088 B2 * 12/2005 Albert et al. ..... 239/88
6,994,559 B1 * 2/2006 Sanftleben ..... 439/34
2006/0038031 A1 * 2/2006 Unruh ..... 239/102.2
2006/0038032 A1 * 2/2006 Plecher et al. ..... 239/102.2

FOREIGN PATENT DOCUMENTS

DE 19844743 9/1998
DE 19715487 10/1998
DE 019844743 C1 * 6/2000

* cited by examiner

*Primary Examiner*—Michael C. Zarroli
(74) *Attorney, Agent, or Firm*—Baker Botts L.L.P.

(57) ABSTRACT

A connection device for electrically connecting contact pins, which protrude from an axial opening of a sleeve-type housing, with terminal pins of a plug connector, which are formed by the device, the connection device having a device body having an insertion section that axially engages the axial opening of the sleeve-type housing and comprises penetration openings for the penetration of the contact pins, and a locating face laterally offset and essentially tangential relative to the insertion section, wherein the locating face interacts with a corresponding locating face of the sleeve-type housing in an anti-rotational manner when the insertion section is inserted in the axial opening, wherein the locating face of the device body comprises inelastic and elastic areas which are tangentially opposite to each other in relation to the insertion section.

20 Claims, 3 Drawing Sheets

DEVICE FOR ELECTRICALLY CONNECTING CONTACT PINS TO TERMINAL PINS OF A PLUG CONNECTOR WHICH IS FORMED BY THE DEVICE

CROSS-REFERENCE TO RELATED APPLICATIONS

This application claims priority from German Patent Application No. 10 2004 053 491.8, which was filed on Nov. 5, 2004, and is incorporated herein by reference in its entirety.

TECHNICAL FIELD

The invention relates to a device for electrically connecting contact pins to terminal pins of a plug connector which is formed by the device. The invention also relates to a use for such a connection device.

BACKGROUND

DE 197 15 487 A1 discloses a connection device of this type in the form of a contact plate which is plugged on to two contact pins of a piezoelectric actuator. The known contact plate is manufactured from insulating plastic and is provided with penetration openings for the penetration of the contact pins which project almost in parallel with the longitudinal direction of the actuator. In the interior of the contact plate, electrical lines are guided from a contacting in each case to terminal pins which protrude laterally from the contact plate. By coating an upper part of an actuator housing and the contact pins including the mounted and contacted contact plate, a plug housing is formed in which the laterally projecting terminal pins protrude into a terminal chamber such that a plug connector is formed at this location, by means of which plug connector the piezoelectric actuator is connectable to an external line arrangement.

DE 198 44 743 C1 likewise discloses a connection device in the form of a contact stud carrier. The known contact stud carrier is used for sealing and positioning contact pins of a piezoelectric actuator for the injection valve of an internal combustion engine and has a device body of plastic featuring penetration openings for penetration of the contact pins. After the contact stud carrier has been mounted on the contact pins of the piezoelectric actuator, the contact pins which protrude from the penetration openings come into contact with the welding clips, said welding clips being molded into the plastic body, and can be welded onto the same. The welding clips are electrically connected to laterally projecting contact studs which function as terminal pins of a plug connector that is formed by means of a plastic coating.

The creation of an electrical connection by means of the known connection devices is problematic to the extent that after installation these devices are often not in a location that is exactly defined, and therefore must often be additionally adjusted manually. Without the position and orientation of the connection device being set thus, the electrical contacting of the contact pins is hindered. Furthermore, in the case of insufficient positioning accuracy, there exists the danger during a subsequent coating of the connection device that coating material undesirably penetrates in through gaps which would be significantly smaller and therefore represent a seal if the location of the connection device was defined exactly.

SUMMARY

The present invention therefore addresses the problem of providing a connection device of the type cited at the beginning, said connection device making it easy to ensure a relatively accurately defined position of the connection device in relation to a housing.

This problem can be solved by a connection device for electrically connecting contact pins, which protrude from an axial opening of a sleeve-type housing, with terminal pins in the connection device, the connection device comprising a device body having an insertion section which is suitably formed for an axial engagement in the axial opening and has penetration openings for the penetration of the contact pins, and a locating face which is laterally offset and extends essentially tangentially relative to the insertion section, said locating face interacting with a corresponding locating face of the sleeve-type housing in an anti-rotational manner when the insertion section is inserted in the axial opening, wherein the locating face of the connection device is formed both inelastically and elastically at locating face areas which are tangentially opposite to each other in relation to the insertion section.

The device body may comprise a plastic molded part which forms both the insertion section and the locating face as a single integral part. The locating face can be formed such that its interaction essentially occurs only at the locating face areas which are tangentially opposite to each other. The elastic locating face area can be formed by a spring element which is added to the locating face. The elastic locating face area can be formed by a spring element which is arranged on the locating face using the two-component injection molding method. The elastic locating face area can be formed by a spring element which is arranged at a small distance from the locating face. The spring element may have an insertion bevel. The device body may comprise a plastic molded part into which are molded the terminal pins, contact parts for contacting the contact pins, and an electrical line arrangement between the terminal pins and the contact parts. Welding clips can be arranged adjacently to the penetration openings in such a way that they can be welded to the contact pins. A fuel injector for an internal combustion engine may comprise an piezoelectric actuator which is housed in an actuator housing and whose contact pins are contacted by means of such a connection device. The fuel injector may comprise a plastic coating which forms a sheath at the fuel injector end on which the plug is mounted. Such a connection device can also be used for electrically contacting the terminal pins of the connection device with contact pins of a piezoelectric actuator of a fuel injector of an internal combustion engine.

In accordance with the invention, provision is made for a connection device for electrically connecting contact pins, which protrude from an axial opening of a sleeve-type housing, to terminal pins of the connection device, wherein a plug connector is formed by the terminal pins of the connection device, wherein the connection device comprises a device body having an insertion section which is suitably formed for the axial engagement in the opening and has penetration openings for the penetration of contact pins, and including a locating face which is laterally offset and extends essentially tangentially relative to the insertion section, said locating face interacting with a corresponding locating face of the housing in an anti-rotational manner when the insertion section is inserted in the opening, wherein the locating face of the connection device is formed both inelastically and elastically at locating face areas which are tangentially opposite to each other in relation to the insertion section.

It is firstly important that the device body has an insertion section for axial engagement in an axial opening of a housing. This already advantageously results in a certain "approximate adjustment" of the position of the connection device during its installation, and allows the provision in a simple manner of comparatively narrow gaps between the connection device and the housing in the form of a small intermediate space between the insertion section and the circumferential surface of the opening. The insertion section can have an approximately cylindrical form overall, for example.

According to the invention, an anti-rotation element and optionally also an improved positioning of the connection device relative to the housing is provided by a locating face of the device body, said locating face extending essentially tangentially and interacting with a corresponding locating face of the housing.

In order more accurately to define the position of the connection device relative to the housing, it is finally essential according to the invention that the locating face of the connection device is formed both inelastically and elastically at locating face areas which are tangentially opposite to each other in relation to the insertion section. This allows a "backlash-free" interaction between the corresponding locating faces and therefore a particularly accurate definition of the position of the connection device.

In a preferred embodiment, the device body comprises a plastic molded part which forms both the insertion section and the locating face as a single integral part. In addition to ease of manufacture, this measure has e.g. the advantage that the locating face which is used to define the position has a particularly exact position in relation to the insertion section.

The locating face is preferably formed such that its interaction with the corresponding locating face of the housing essentially occurs only at the locating face areas which are tangentially opposite to each other. In this way, the advantageous effect of the different elasticities is optimally utilized.

The elastic locating face area can be implemented in a multiplicity of ways, e.g. by means of a spring element which is provided for this purpose in the corresponding locating face area, said spring element being made of a relatively elastic material. Such a spring element can be added to the locating face as a separate component, for example, which is subsequently attached to the locating face (e.g. by adhesion, welding, locking, etc.). Alternatively, for example, the elastic locating face area can be formed by a spring element which is arranged on the locating face as part of the two-component injection molding method.

It is also conceivable to provide a spring element which is formed from a relatively inelastic material, and nonetheless attain an elasticity of the relevant locating face area which elasticity is sufficient for the invention. This can be achieved e.g. by arranging the spring element at a certain distance from the locating face and attaching it at only one end. Such a spring element can therefore provide a considerable elasticity by virtue of a flexibility of the spring element. The spring element can be compressed towards the locating face to a certain extent. The same applies for a relatively thin spring element having the form of a lamina, said spring element being attached to the locating face at both ends (e.g. molded as a unitary part) but extending at a distance from the locating face in a central area.

In order simply and reliably to effect the interaction of the corresponding locating faces when the insertion section is inserted into the opening of the housing, it is advantageous if at least one of the locating faces and/or an optionally provided spring element features an insertion bevel. It is also beneficial if a free end of the insertion section features an insertion bevel which is e.g. annularly circumferential, thereby facilitating the insertion into the opening of the housing.

In an embodiment, provision is made for the device body to comprise a plastic molded part (e.g. the aforementioned part which forms both the insertion section and the locating face) into which are molded the terminal pins, contact parts for contacting the contact pins, and an electrical line arrangement between the terminal pins and the contact parts. In particular, it is possible essentially to create the whole connection device from a single plastic body into which the aforementioned components are molded.

In a preferred embodiment, contact parts for contacting the contact pins are designed as welding clips which are to be welded to the contact pins. Such welding clips are preferably arranged adjacently to the penetration openings in such a way that they touch the contact pins and are therefore particularly easy to weld.

A preferred use of the connection device is the electrical contacting of contact pins of a piezoelectric actuator of a fuel injector of an internal combustion engine. The fuel injector can be a diesel injector of a common rail injection system, for example.

BRIEF DESCRIPTION OF THE DRAWINGS

The invention is described in greater detail below with reference to an exemplary embodiment and to the attached drawings in which.

DETAILED DESCRIPTION

Figure 1:
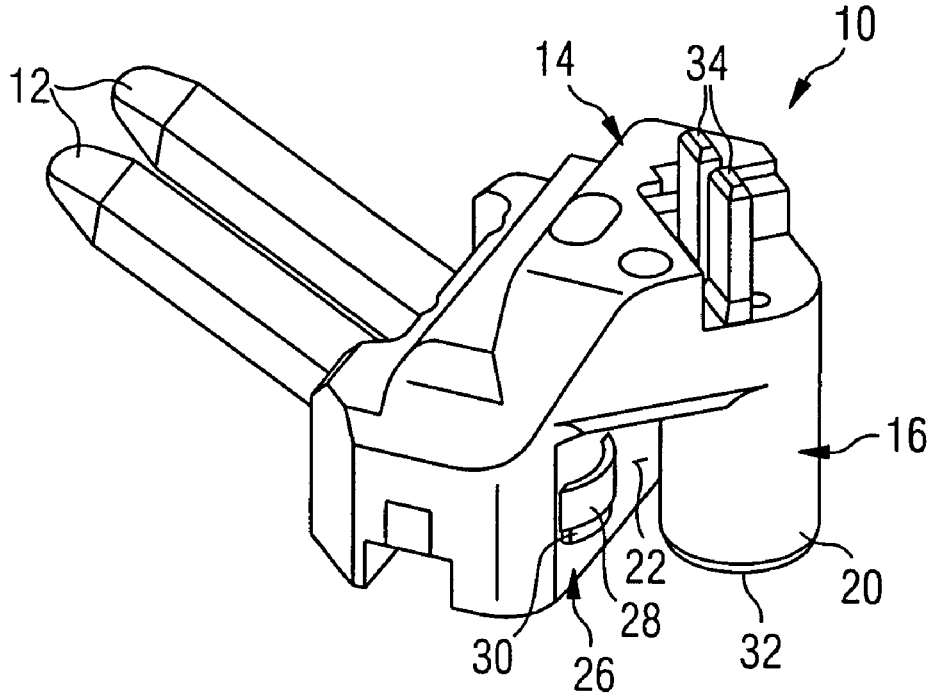
FIG. 1 is a perspective view of a contact stud carrier in accordance with the invention as viewed obliquely from above.
Figure 2:
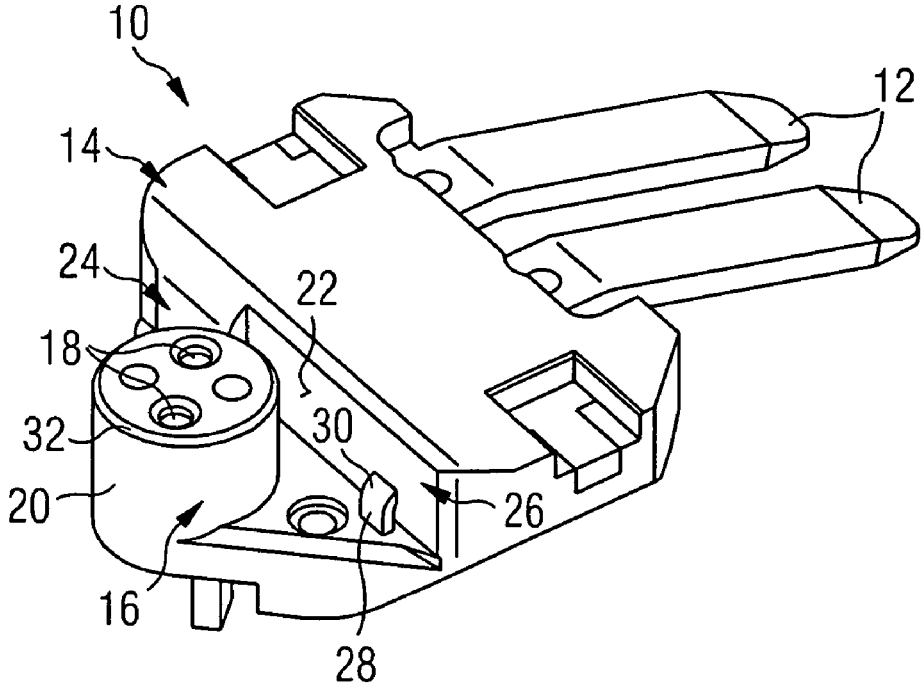
FIG. 2 is a perspective view of the contact stud carrier as viewed obliquely from below, wherein a variant is illustrated.

FIGS. 1 and 2 show a contact stud carrier (connection device), which overall is designated as 10, for electrically connecting contact pins of a piezoelectric actuator (not shown) with contact studs 12 (terminal pins). The terminal pins 12 are molded into a plastic body 14. The terminal pins 12, in conjunction with a plastic coating (not illustrated), form a plug connector of a fuel injector.

The body 14 in the illustrated example is an integrally manufactured plastic molded part and has a cylindrical insertion section 16 which is suitably formed for axial engagement in an axial opening of a sleeve-type housing of the fuel injector and features penetration openings 18 for the penetration of the contact pins of the piezoelectric actuator, and includes a locating face 22 which is laterally offset relative to the insertion section 16 and extends essentially tangentially at a distance from a circumferential surface 20 of the insertion section 16. After an installation of the connection device 10, during which the insertion section 16 is axially inserted into the opening of the injector housing, the locating face 22 interacts in an anti-rotational manner with a corresponding locating face of this injector housing, said interaction being described below. The locating face 22 of the connection device 10 has two locating face areas 24, 26 which are tangentially opposite to each other in relation to the insertion section 16, wherein the one area 24 is inelastically formed whereas the other area 26 is elastically formed. The inelastic area 24 is provided by the upper surface of the body 14 which is manufactured from inelastic plastic, whereas the elastic area 26 is provided by a spring element 28 (FIG. 1) which is added to the locating face 22.

In general, there is a multiplicity of possibilities for the structure of the spring element 28. Therefore the spring element 28 which is illustrated in FIG. 1 and extends in a curved manner at the locating face 22 could also be integrally formed (instead of being added as a separate part). In order to illustrate a further variation possibility relating to this, 2 different structures are drawn in the FIGS. 1 and 2. A curved spring lamina is adhered to the surface of the area 26 at both ends in FIG. 1, whereas a spring projection 28 which is manufactured integrally with the remaining plastic body 14 is arranged at a small distance from said surface in FIG. 2. This vertically arranged spring element 28 advantageously has a good releasability in the injection-molding tool.

In the variant that is illustrated in FIG. 1 for the spring element 28, the elasticity of the locating face area 26 is based on the comparatively thin design of a lamina that is altogether curved and/or on the increased elasticity of the spring lamina material in relation to the material of the plastic body 14.

In the variant that is illustrated in FIG. 2 for the spring element 28, the elasticity of the locating face area 26 is based on the comparatively thin design of the spring lamina, which can be compressed in the direction of the locating face which lies behind it.

For both variants, the locating face 22 has a "recessed surface area" in which the plastic spring element 28 is arranged.

The formation of a spring element having increased elasticity in a two-component injection molding method together with the formation of the remaining plastic body 14 is also conceivable.

In both variants (FIG. 1 and FIG. 2), the spring element 28 is provided with an insertion bevel 30, by means of which the interaction that occurs between the locating face 22 and the corresponding locating face of the housing as a result of inserting the insertion section 16 into the opening of the injector housing is easily and reliably achieved.

In order additionally to simplify the insertion of the insertion section 16 into the housing opening, an annularly circumferential insertion bevel 32 is provided at the free end of the insertion section 16.

In addition to the penetration openings 18, the insertion section 16 additionally has two blind holes (cf. FIG. 2) which likewise provide at least an elementary anti-rotation element.

When manufacturing the connection device 10, the terminal pins 12 which lead to welding clips 34 via an integrally formed electrical line arrangement (in the interior of the plastic body 14) are molded into the plastic material that is used to form the plastic body 14.

When the connection device 10 is installed, the contact pins of the piezoelectric actuator penetrate through the penetration openings 18 and, with their ends, touch the welding clips 34 which are arranged adjacently to said penetration openings 18, such that the contact pins can easily be welded to the welding clips 34 in order to create an electrical contact.

Figure 3:
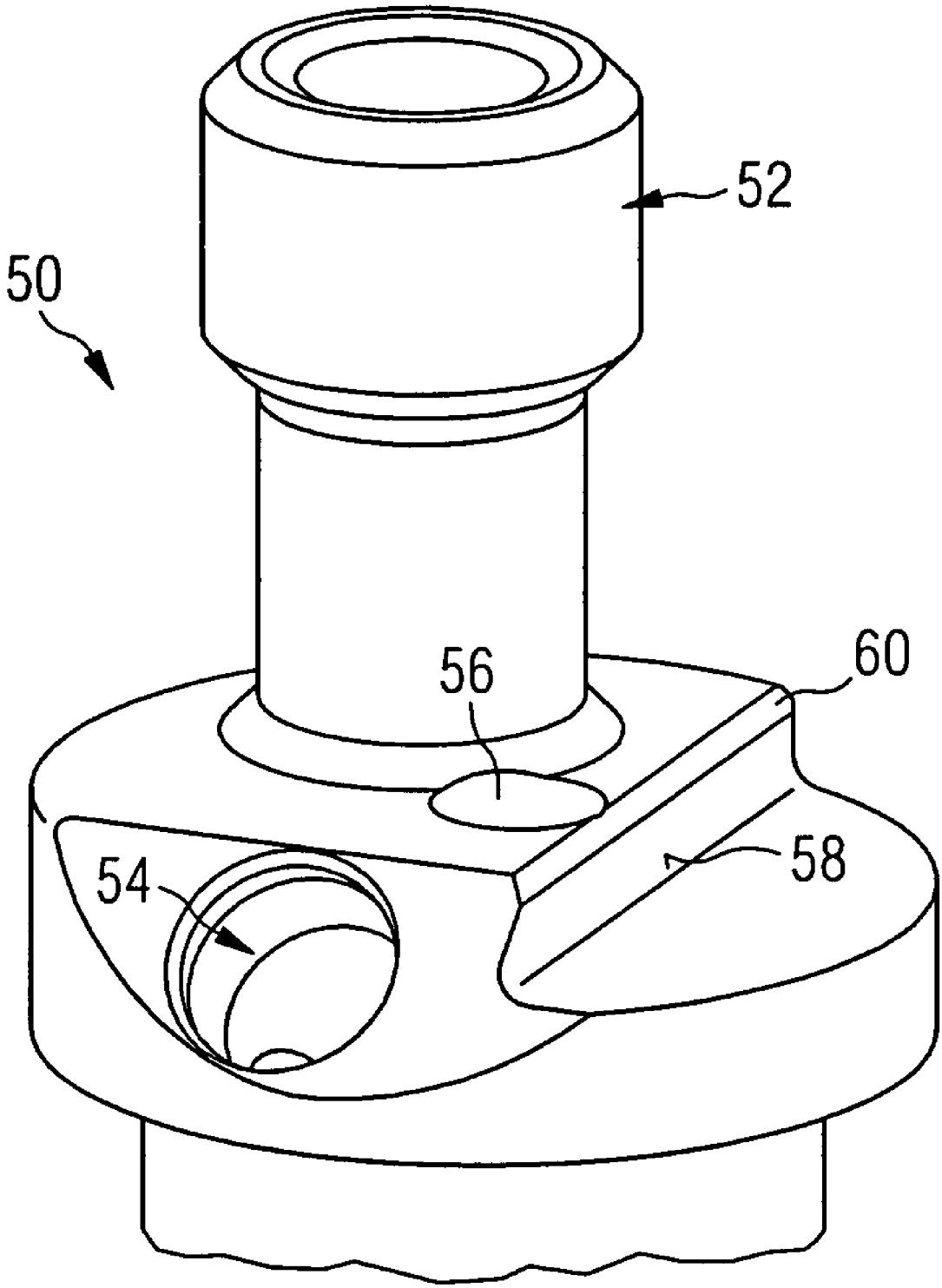
FIG. 3 is a perspective view of an upper end portion of a fuel injector housing which must be equipped with the contact stud carrier from FIG. 1.

FIG. 3 shows the upper part (remote from the injection nozzle) of the injector housing, which injector housing overall is designated as 50, before the installation of the above described connection device 10.

The injector housing 50 has a high-pressure fuel supply connection 52 and a fuel leakage connection 54, in order to supply a hydraulic fuel servo-valve in a manner which is known per se and therefore requires no explanation here, said hydraulic fuel servo-valve being arranged in the lower area of the housing 50 (not illustrated). The control of the servo-valve is performed by means of the piezoelectric actuator which is likewise arranged in the lower area of the housing 50 and is connected to a final control element of the servo-valve via an active connection.

Also recognizable in FIG. 3 is the axial opening 56 of the housing 50, said housing having the overall form of a sleeve (sleeve-type housing 50), from which axial opening 56 the contact pins of the piezoelectric actuator protrude upwards after an installation (from below) of a piezoelectric module which contains the piezoelectric actuator.

Subsequent to the installation of the piezoelectric module in the injector housing 50, the connection device 10 which is described above with reference to FIGS. 1 and 2 is placed onto the housing 50 from above, such that the contact pins of the piezoelectric actuator penetrate through the penetration openings 18 of the insertion section 16 and can then be welded onto the welding clips 34. In order to achieve an optimally defined position of the installed connection device 10 in relation to the housing 50, the housing 50 has a tangentially extending locating face 58 which interacts with the above described locating face 22 of the connection device 10. In order to place the corresponding locating faces 22, 58 in the reciprocal position in a simple and reliable manner, provision is made for an oblique surface 60 which adjoins the locating face 58 on the housing 50.

Figure 4:
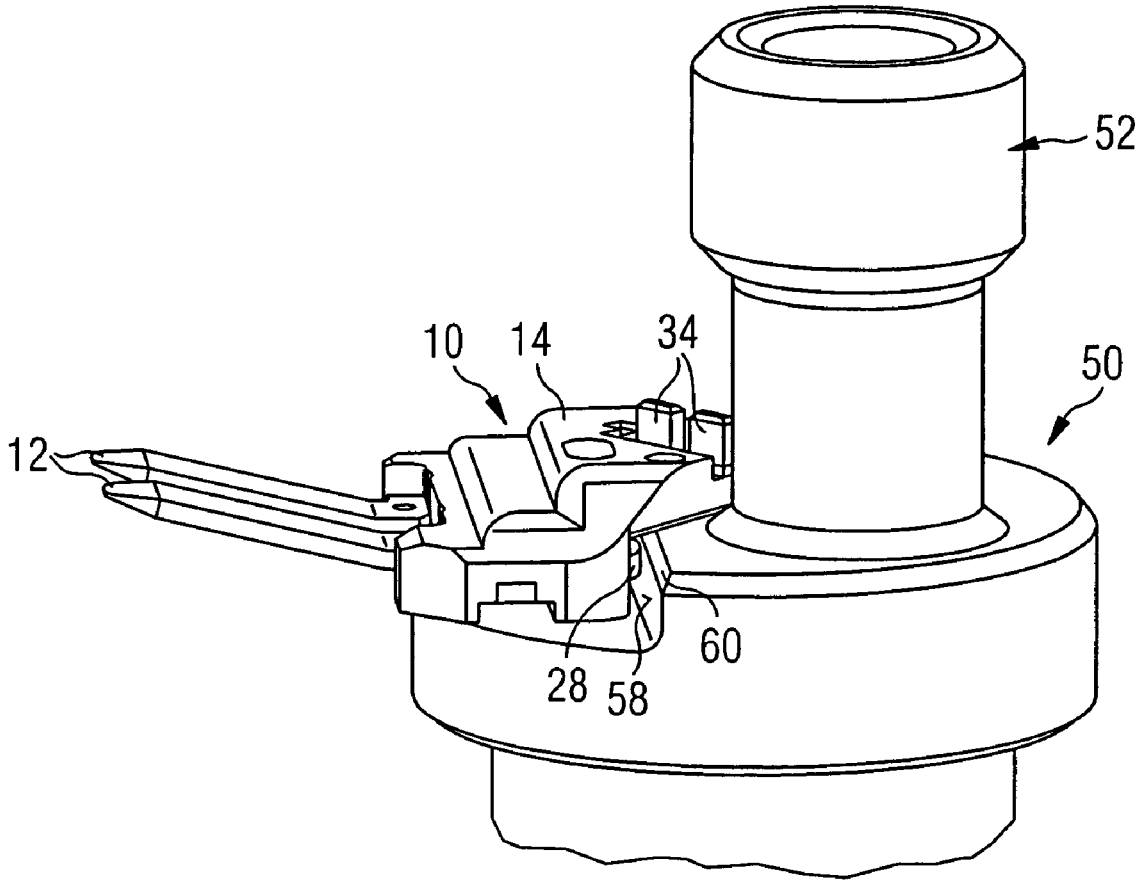
FIG. 4 is a perspective view of the injector housing with installed contact stud carrier.

FIG. 4 shows the situation immediately after the placement of the connection device 10 on the injector housing 50. The contact pins of the piezoelectric actuator touch the welding clips 34 in this situation and are welded to the same. A plastic coating which is applied to the illustrated end of the injector housing 50 then forms a plastic sheath (not illustrated), thereby also providing a plug housing for the plug connector which is formed by means of the terminal pins 12.

The stop between the connection device 10 and the recess in the injector housing 50, said recess being visible in this figure, ensures an anti-rotation element whose accuracy is significantly increased by the elastic locating face area.

In particular, in order to achieve an optimal position between the welding clips 34 and the contact pins of the piezoelectric actuator and in order to achieve a maximally coaxial arrangement of the insertion section 16 in the housing opening, the construction of the locating face 22 with both an inelastic locating face area 24 and an elastic locating face area 26 is particularly significant. The interaction of the locating faces 22 and 58 essentially only occurs at the opposing locating face areas 24, 26, wherein the elasticity which is achieved by means of the spring element 28 reliably and accurately positions the connection device 10 and therefore its insertion section 16 already before the welding (and also before the plastic coating).

The fundamental idea of the described embodiment is the implementation of a spring element (or a plurality of spring elements) 28 (e.g. of plastic) in the connection device 10 for fixing the radial position and for equalizing the tolerance of the corresponding locating faces or stop faces 22, 58. The number and geometric construction of the spring element or elements 28 can be configured variously to suit the relevant overall design. In combination with a stop which is arranged tangentially opposite, the spring element or elements which are integrated in the area of the connection device 10 can provide a particularly precise anti-rotation element and ensure a tolerance equalization of the locating faces. This results in e.g. the following advantages:

Minimizing the radial play of the connection device on the injector housing.

Avoiding a costly additional positioning of the connection device manually before coating the housing end on which the plug is mounted.

Optimizing the tolerance equalization of the locating faces in the event of a rotation of the connection device on the injector housing.

If the spring element or spring elements are directly integrated into a plastic body of the connection device: elimination of the requirement for additional components (as spring elements).

If a (final) plastic coating of the housing end on which the plug is mounted is planned, any relaxation of the spring element or spring elements during the service life of the injector is irrelevant since the position of the components which are enclosed by plastic, in particular including the connection device with spring element therefore, are in any case "frozen" in their position when the plastic material is sprayed.

What is claimed is:

1. A connection device for electrically connecting contact pins, which protrude from an axial opening of a sleeve-type housing, with terminal pins of the connection device, the connection device comprising:

a device body comprising:

an insertion section that axially engages the axial opening and comprises penetration openings for the penetration of the contact pins, and a locating face laterally offset and essentially tangential relative to the insertion section, wherein the locating face interacts with a corresponding locating face of the sleeve-type housing in an anti-rotational manner when the insertion section is inserted in the axial opening, wherein the locating face of the device body comprises inelastic and elastic areas which are tangentially opposite to each other in relation to the insertion section, with the elastic area comprising a spring element.

2. A connection device according to claim 1, wherein the the insertion section and the locating face comprise a single integral plastic molded part.

3. A connection device according to claim 1, wherein the inelastic and elastic areas of the locating face of the device body interact essentially only with areas of the locating face of the sleeve-type housing which are tangentially opposite to to the inelastic and elastic areas of the locating face of the device body.

4. A connection device according to claim 1, wherein the elastic area of the locating face of the device body comprises a spring element which is added to the locating face.

5. A connection device according to claim 1, wherein the elastic of the locating face of the device body comprises a spring element which is arranged on the locating face using the two-component injection molding method.

6. A connection device according to claim 1, wherein the elastic area of the locating face of the device body comprises a spring element which is arranged at a small distance from the locating face.

7. A connection device according to claim 4, wherein the spring element comprises an insertion bevel.

8. A connection device according to claim 1, wherein the the terminal pins, contact parts for contacting the contact pins, and an electrical line arrangement between the terminal pins and the contact parts are molded into a plastic part of the device body.

9. A connection device according to claim 1, further comprising welding clips arranged adjacent to the penetration openings, wherein the welding clips are weldable to the contact pins.

10. A fuel injector for an internal combustion engine, comprising:

a connection device for electrically connecting contact pins, which protrude from an axial opening of a sleeve-type housing, with terminal pins of the connection device, the connection device comprising:

a device body comprising:

an insertion section that axially engages the axial opening and comprises penetration openings for the penetration of the contact pins, and a locating face laterally offset and essentially tangential relative to the insertion section, wherein the locating face interacts with a corresponding locating face of the sleeve-type housing in an anti-rotational manner when the insertion section is inserted in the axial opening, wherein the locating face of the device body comprises inelastic and elastic areas which are tangentially opposite to each other in relation to the insertion section, with the elastic area comprising a spring element; and a piezoelectric actuator which is housed in an actuator housing and whose contact pins are contacted by means of a connection device according to claim 1.

11. A fuel injector according to claim 10, wherein the fuel injector end on which the plug is mounted comprises a plastic coated sheath.

12. A method for electrically connecting, with a connection device, contact pins, which protrude from an axial opening of a sleeve-type housing of a piezoelectric actuator of a fuel injector of an internal combustion engine, with terminal pins of the connection device, the connection device comprising:

a device body comprising:

an insertion section that axially engages the axial opening and comprises penetration openings for the penetration of the contact pins, and a locating face laterally offset and essentially tangential relative to the insertion section, wherein the locating face interacts with a corresponding locating face of the sleeve-type housing in an anti-rotational manner when the insertion section is inserted in the axial opening, wherein the locating face of the device body comprises inelastic and elastic areas which are tangentially opposite to each other in relation to the insertion section, with the elastic area comprising a spring element; and the method comprising the step of electrically contacting the terminal pins of the connection device with the contact pins of the piezoelectric actuator of the fuel injector of the internal combustion engine.

13. A connection device having a device body comprising:

an insertion section that is axially engageable in an axial opening of a sleeve-type housing, penetration openings in the insertion section for the penetration of contact pins, a locating face which is laterally offset and extends essentially tangentially relative to the insertion section, wherein said locating face interacts with a corresponding locating face of the sleeve-type housing in an anti-rotational manner when the insertion section is inserted in the axial opening, and wherein the locating face of the connection device comprises inelastic and elastic areas which are tangentially opposite to each other in relation to the insertion section, with the elastic area comprising a spring element.

14. A connection device according to claim 13, wherein the insertion section and the locating face comprise as a single plastic molded integral part of the device body.

15. A connection device according to claim 13, wherein the inelastic and elastic areas of the locating face of the device body interact essentially only with areas of the locating face of the sleeve-type housing which are tangentially opposite to to the inelastic and elastic areas of the locating face of the device body.

16. A connection device according to claim 13, wherein the elastic area of the locating face of the device body comprises a spring element which is added to the locating face.

17. A connection device according to claim 13, wherein the elastic area of the locating face of the device body comprises a spring element which is arranged on the locating face using the two-component injection molding method.

18. A connection device according to claim 13, wherein the elastic area of the locating face of the device body comprises a spring element which is arranged at a small distance from the locating face.

19. A connection device according to claim 16, wherein the spring element comprises an insertion bevel.

20. A connection device according to claim 13, wherein the the terminal pins, contact parts for contacting the contact pins, and an electrical line arrangement between the terminal pins and the contact parts are molded into a plastic part of the device body.

* * * * *